United States Patent [19]

Buckle et al.

[11] Patent Number: 4,527,582

[45] Date of Patent: Jul. 9, 1985

[54] DEPTH RESPONSIVE GAS CONTROL DEVICE

[75] Inventors: Brian L. Buckle; Neil C. Heesom, both of Colwyn Bay, United Kingdom

[73] Assignee: Buoyco (Divers) Limited, United Kingdom

[21] Appl. No.: 448,208

[22] Filed: Dec. 9, 1982

[30] Foreign Application Priority Data

Dec. 11, 1981 [GB] United Kingdom ..... 8137472

[51] Int. Cl.[3] ..... F16K 17/36

[52] U.S. Cl. ..... 137/81.2; 128/204.29

[58] Field of Search ..... 137/81.2; 128/204.29

[56] References Cited

U.S. PATENT DOCUMENTS

| | | | |
|---|---|---|---|
| 2,894,507 | 7/1959 | Seeler | 128/204.29 |
| 3,054,414 | 9/1962 | Blackwell | 137/81.2 |
| 4,230,140 | 10/1980 | Hart | 137/81.2 |
| 4,396,032 | 8/1983 | Duchesne et al. | 137/81.2 |

FOREIGN PATENT DOCUMENTS 1532411 11/1978 United Kingdom .

*Primary Examiner*—A. Michael Chambers

*Attorney, Agent, or Firm*—Cushman, Darby & Cushman

[57] ABSTRACT

A device for automatically opening a gas supply valve when the device reaches a predetermined depth, e.g. when diving, has a gas reservoir, a pressure sensing means providing a control signal when the ambient pressure exceeds that of the gas reservoir, and a supply valve which is opened upon receipt of that signal. A preferred embodiment has a flexible diaphragm exposed at its faces respectively to the ambient pressure and to the gas reservoir pressure, and arranged to move an actuator which acts directly or indirectly on the gas supply valve. Underwater buoyancy apparatus, for use for example by a diver, has a buoyancy chamber to which as can be supplied to alter buoyancy, and the device is incorporated between a gas supply and the buoyancy chamber to give automatic increase of buoyancy when a predetermined depth is reached.

10 Claims, 5 Drawing Figures

Fig. 1.
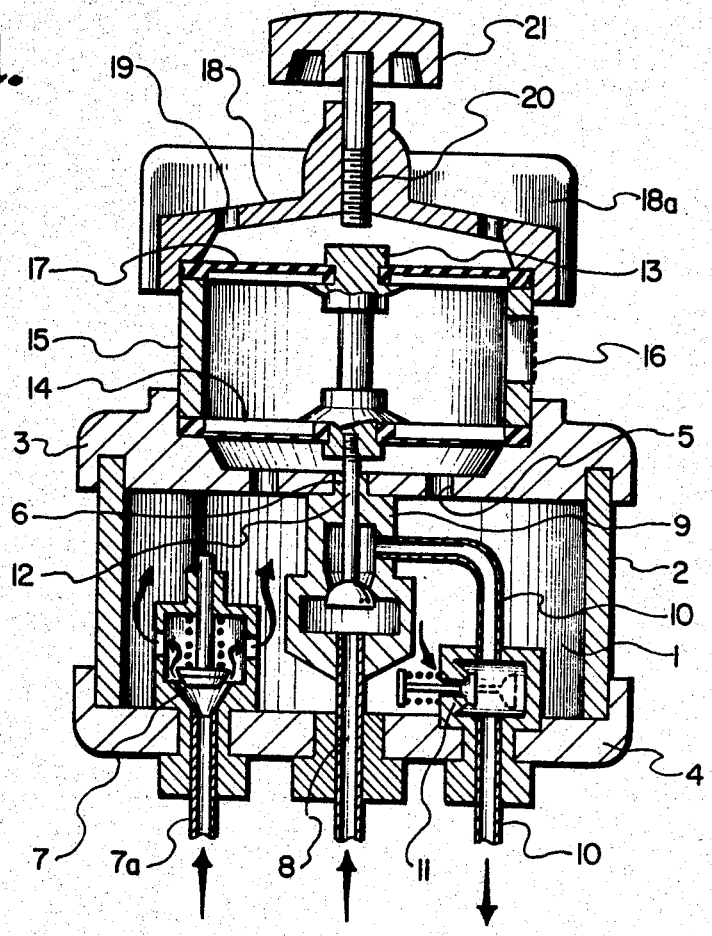
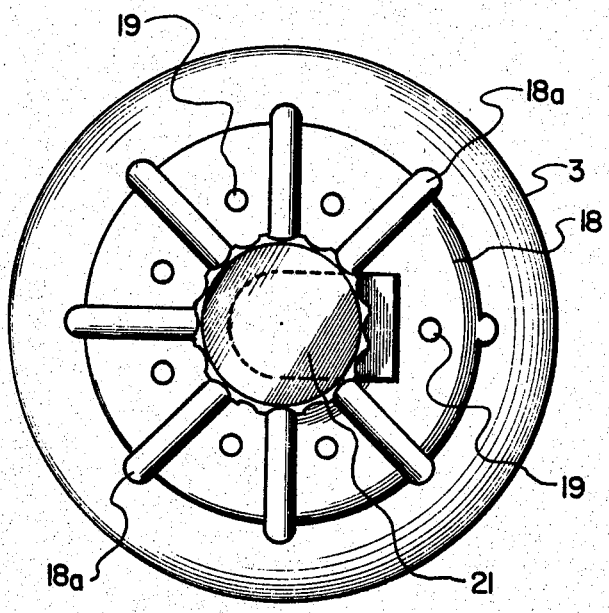
Fig. 3.
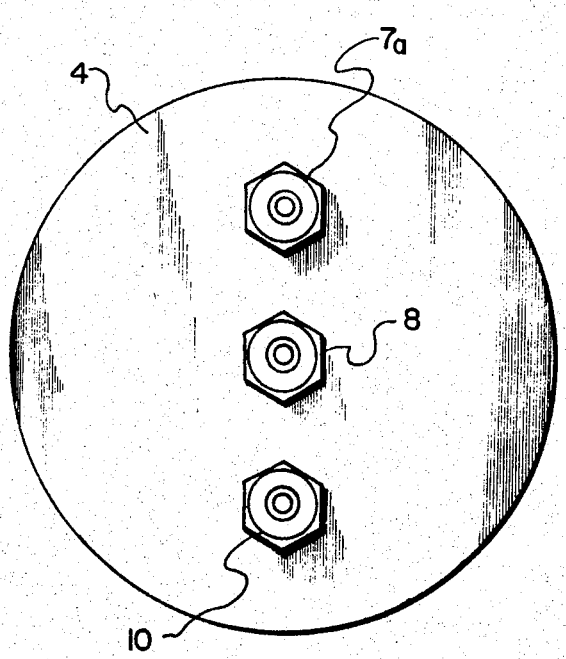
Fig. 4.

DEPTH RESPONSIVE GAS CONTROL DEVICE

BACKGROUND OF THE INVENTION

This invention relates to a gas control device which is responsive to reaching a predetermined depth, in ambient fluid, for opening a valve controlling a supply of gas. It is of particular utility in, but is not restricted in its use to, providing increase of buoyancy in an underwater buoyancy apparatus.

By way of illustration, it is important that a diver should not exceed the maximum depth to which he intends to dive. However, it is often difficult for a diver to ensure that this intended maximum depth is not exceeded. For example, the underwater visibility may be so limited that the diver cannot read a depth gauge attached to his wrist. Further, the diver may become distacted or have his judgment impaired during diving so that he does not appreciate, or perhaps, care that the intended maximum depth has been exceeded.

SUMMARY OF THE INVENTION

A first object of the invention is to provide a gas control device which is responsive to reaching a predetermined depth in ambient fluid to automatically open a valve controlling a supply of gas.

A second object of the invention is to provide underwater buoyancy apparatuses of the kind having a buoyancy chamber to which gas may be supplied to increase buoyancy of the apparatus, incorporating such a device for controlling said supply, such that for example, a diver carrying the buoyancy apparatus will be prevented, by automatic increase of the buoyancy of the apparatus, from exceeding the intended maximum depth.

According to the present invention, a device for automatically opening a gas supply valve when the device reaches a predetermined depth in a fluid, comprises a gas reservoir, a pressure sensing means monitoring the difference in pressure between gas in said reservoir and the ambient fluid, said sensing means providing a control signal when the pressure of the ambient fluid exceeds the pressure of the gas reservoir, and a gas supply valve which is responsive to said signal to become opened.

Usually, but not necessarily, the gas reservoir will be a fixed volume reservoir, and conveniently, it can be constituted by a cylindrical gas chamber. Preferably, means are proided for adjusting the pressure of gas in said gas reservoir so as to vary the depth at which the valve means is actuated. Said pressure adjustment means is conveniently in the form of a tire inflation valve of the Schrader type.

Preferably, the pressure sensing means comprises a flexible diaphragm which has one major surface exposed to the ambient fluid and which has its other opposed major surface exposed to the gas of the gas reservoir. Conveniently, the gas reservoir has a wall with an opening or openings therein, and said diaphragm is mounted on said wall covering each said opening.

When the pressure sensing means comprises a diaphragm as mentioned above, the control signal may be provided by movement of a rigid actuating member extending from and movable with said diaphragm, said actuating member acting directly or indirectly on said gas supply valve. For example, the actuating member may act on electrical, hydraulic, pneumatic or mechanical switching means controlling the gas supply valve.

Conveniently, the gas supply valve is disposed within the gas reservoir, whereby the dimensions of the control device can be kept relatively small.

The valve would normally remain closed until the device reaches a predetermined depth in the ambient fluid. However, over-ride means may be provided for acting on said gas supply valve to open it independently of provision of said signal, e.g. for opening the valve at depths less that the maximum depth determined by the pressure of the gas in the reservoir.

Further according to the invention, there is provided an underwater buoyancy apparatus comprising the device as set forth herein and a buoyancy chamber connected to receive gas to increase the buoyancy of the apparatus from the gas supply valve. The buoyancy apparatus might be carried by a diver, but the invention is applicable also to a buoyancy apparatus for other purposes, such as for use with an underwater vehicle.

The following is a description, by way of example only and with reference to the accompanying drawings, of a presently preferred embodiment of the device, and of a buoyancy apparatus incorporating the device.

BRIEF DESCRIPTION OF THE DRAWINGS

FIG. 1 is a diagrammatic, cross-sectional view of a gas supply valve opening device, taken along line A—A of FIG. 2;

FIG. 3 is a plan view of the device of FIG. 1;

FIG. 4 is an underplan view of the device of FIG. 1; and

DETAILED DESCRIPTION OF THE SHOWN EMBODIMENT

Figure 2:
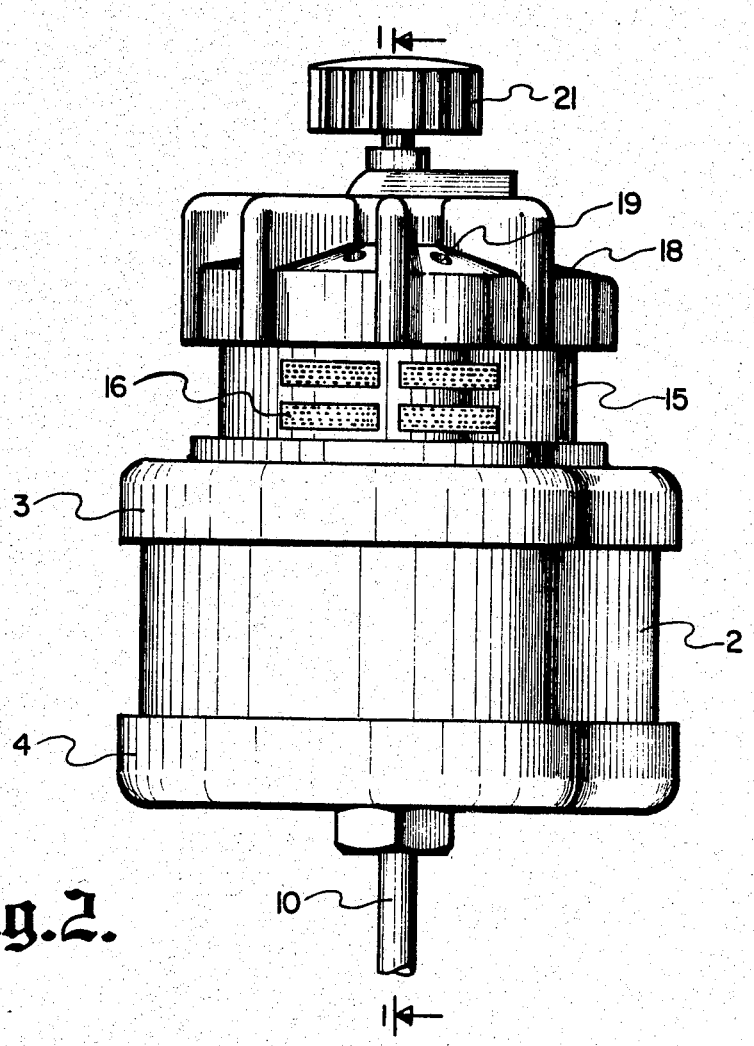
FIG. 2 is a side elevational view of the device of FIG. 1.

Referring particularly to the drawings, there is shown a gas reservoir 1 formed by a short length of cylindrical tube 2 closed at each end by base caps 3, 4. The upper base cap 3 has a plurality of axial holes 5 extending therethrough. These holes are arranged in a ring concentric with the base cap 3. A further axial hole 6 extends through the center of the base cap 3. The lower base cap 4 is provided with a Schrader-type tire inflation valve 7 through which air can be admitted into or discharged from the reservoir 1 via a pipe 7*a*. An air supply pipe 8 extends through the base cap 4 to a poppet valve 9 which is attached to and extends from the center of the upper base cap 3. An air outlet pipe 10 also extends through the base cap 4 to communicate with the outlet of the valve 9. A relief valve 11 is provided within the reservoir 1 to permit discharge of air from the reservoir through the pipe 10 if the air in the reservoir exceeds a predetermined maximum pressure. For example, said pressure can be in the range of 80 to 100 pounds per square inch.

An operating stem 12 of the valve 9 extends through the central hole 6 in the base cap 3 to protrude from the upper surface of the base cap. The protruding end of the stem 12 is threaded and is threadably received in the base of a co-axial spindle 13. The base of the spindle is secured to a lower diaphragm 14 which extends radially beyond the ring of holes 5. The periphery of the diaphragm 14 is clamped in a fluid tight manner between the base cap 3 and an upper cylindrical tube 15 threadably connected thereto. The tube 15 has a plurality of circumferentially spaced holes 16 to permit entry of ambient water.

The other end of the spindle 13 is secured to the center of a second diaphragm 17 which is secured at its periphery between the upper tube 15 and a top cap 18 threadably received thereon. This second diaphragm 17 is provided to stabilize the action of the lower diaphragm 14. The top cap 18 has several holes 19 extending axially therethrough to allow entry of ambient water into the chamber formed between the upper diaphragm 17 and the top cap 18. In that manner, both surfaces of the upper diaphragm 7 are exposed to the same water pressure. Strengthening ribs 18*a* are provided on the top cap 18.

Optionally, a threaded bore 20 is formed through the center of the top cap 18 to receive a manually operable turn screw 21. The lower end of the turn screw 21 is aligned with the upper end of the spindle 13 whereby clockwise rotation of the turn screw causes the screw to bear down on the spindle.

The depth at which the limiting valve is to operate is determined by the pressure of air within the reservoir 1. Air is introduced into the reservoir 1 by, for example, a foot pump or compressed air line attached to the pipe 7*a*. If the pressure exceeds the maximum intended operating pressure, the relief valve 11 operates to exhaust air through the outlet pipe 10. Air pressure within the reservoir 1 can be adjusted as required, e.g. before each dive.

Figure 5:
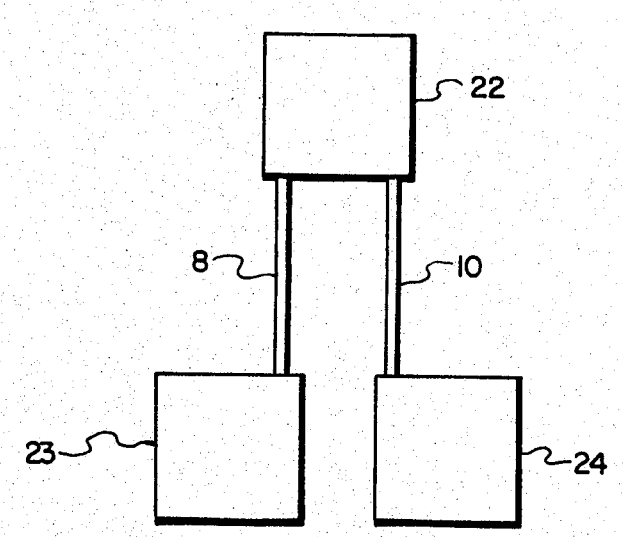
FIG. 5 is a schematic diagram of a buoyance apparatus incorporating the device of this invention.

Referring particularly to FIG. 5, the air inlet pipe 8 of the device of FIGS. 1–4, denoted by reference 22, is connected to a source 23 of low pressure air of a self-contained underwater buoyancy apparatus to be carried by a diver. A suitable apparatus is that described in United Kingdom Pat. No. 1,484,347 or No. 1,523,195, the disclosure of which is incorporated hereby by reference. The outlet pipe 10 of device 22 is connected to the buoyancy chamber 23 of the buoyancy apparatus.

During storage or normal use, the air pressure within the reservoir 1 acting on the lower surface of the lower diaphragm 14 is greater than the ambient fluid pressure acting on the upper surface of the diaphragm 14. as a result, the diaphragm 14, when viewed from below, is maintained in a concave configuration and the stem 12 is maintained in an extended position, whereby the valve 9 is closed isolating the inlet pipe 8 from the outlet pipe 10. However, when a depth is reached at which the water pressure exceeds the reservoir air pressure, the diaphragm 14 will be flattened by the excess water pressure thereby moving the stem 12 downwardly and opening the valve 9. When the valve 9 opens, air is permitted to pass from the inlet pipe 8 through the outlet pipe 10 and hence into the buoyancy chamber 23. The resultant increase in buoyancy causes the diver to rise to a lesser depth thereby reducing the water pressure on the diaphragm 14. When the water pressure has been reduced to a pressure below that of the air in the reservoir 1, the diaphragm 14 will again adopt its concave configuration moving the stem 12 upwardly and thereby once again closing the valve 9.

If it is required to manually actuate the device, the turn screw 21 is turned clockwise to abut and depress the spindle 13 thereby forcing the stem 12 downwardly and opening the valve 9. Counterclockwise movement of the turn screw 21 will release the spindle 13 permitting it to return to its normal position in response to movement of the diaphragm 14.

It is an advantage if the gas reservoir 1 can be made of small dimensions, for compactness of the device. If the reservoir is made of small capacity, the device becomes more sensitive to the pressure put into the reservoir. A very convenient way of applying pressure to the reservoir, where the device is being used in conjunction with a diver's ordinary diving apparatus including (i) an air cylinder, (ii) a first stage of a conventional regulator, and (iii) a second stage of a conventional regulator, is to have a second line from the second stage of the regulator with a pressure gauge incorporated in the line. It is then possible to insert air into the device with great accuracy.

What is claimed is:

1. A gas control device responsive upon reaching a selected predetermined depth in an ambient fluid comprising:

means defining a substantially fixed volume, closed gas reservoir for containing a quantity of a gas at substantially a predetermined pressure indicative of said selected predetermined ambient fluid depth;

pressure sensing means in operative communication with said ambient fluid and said gas in said gas reservoir for (a) monitoring the difference in pressure between said gas in said gas reservoir and the ambient fluid and (b) providing a control signal in response to the pressure of the ambient fluid exceeding said predetermined pressure of said gas;

means defining a flow path in fluid isolation from said gas in said gas reservoir at least when said gas in said gas reservoir is at a pressure less than a maximum pressure, said maximum pressure being greater than said predetermined pressure, said flow path having inlet and outlet ends between which a working fluid is capable of flowing; and gas supply valve means operatively connected to said pressure sensing means to receive said control signal and being in communication with said flow path, said gas supply valve means having open and closed positions for respectively opening and closing fluid communication of said flow path between said inlet and outlet ends and for moving to said open position in response to receiving said control signal to thereby permit working fluid to flow in said flow path when said predetermined depth is reached.

2. The device as claimed in claim 1 further comprising adjusting means for permitting the selectable adjustment of said predetermined pressure of said gas in said gas reservoir thereby permitting selection of said predetermined ambient fluid depth.

3. The device as claimed in claim 1 wherein said pressure sensing means comprises a flexible diaphragm having one major surface exposed to the ambient fluid and another major surface, opposed to said one major surface, exposed to said gas contained in said gas reservoir.

4. The device as claimed in claim 1 wherein said gas supply valve means is disposed within said gas reservoir.

5. The device as claimed in claim 1 further comprising over-ride means for acting on said gas supply valve means independently of said control signal.

6. A device as claimed in claim 1 further comprising relief valve means operatively associated with said flow path for establishing fluid communication between said flow path and said gas reservoir when said gas in said gas reservoir is at least at said maximum pressure thereby allowing pressure relief of said gas reservoir through said flow path.

7. A device as claimed in claim 1 further comprising inlet valve means in operative association with said gas reservoir for selectively admitting and discharging gas into and from said gas reservoir, respectively.

8. The device as claimed in claim 3 wherein said gas reservoir includes a wall defining at least one opening therein, said diaphragm being mounted on said wall covering said opening.

9. The device as claimed in claim 3 further comprising rigid actuating means extending from and movable with said diaphragm for connecting said diaphragm with said gas supply valve means.

10. The device as claimed in claim 9 further comprising switching means, said rigid actuating means connected to said switching means for controlling said gas supply valve means.

* * * * *